US012421684B2

(12) United States Patent
Yuan et al.

(10) Patent No.: US 12,421,684 B2
(45) Date of Patent: Sep. 23, 2025

(54) METHOD FOR PREVENTING SUDDEN SUBSIDENCE OF OPEN CAISSON IN SOFT FOUNDATION

(71) Applicants: CHINA TIESIJU CIVIL ENGINEERING GROUP CO., LTD., Hefei (CN); THE THIRD CONSTRUCTION CO., LTD. OF CTCE GROUP, Tianjin (CN)

(72) Inventors: Rui Yuan, Tianjin (CN); Lin Qin, Tianjin (CN); Gang Huang, Tianjin (CN); Qianchao Yin, Tianjin (CN); Hao Hong, Tianjin (CN); Jianlong Yan, Tianjin (CN)

(73) Assignees: CHINA TIESIJU CIVIL ENGINEERING GROUP CO., LTD., Hefei (CN); THE THIRD CONSTRUCTION CO., LTD. OF CTCE GROUP, Tianjin (CN)

( * ) Notice: Subject to any disclaimer, the term of this patent is extended or adjusted under 35 U.S.C. 154(b) by 217 days.

(21) Appl. No.: 18/347,006

(22) Filed: Jul. 5, 2023

(65) Prior Publication Data

US 2023/0358010 A1 Nov. 9, 2023

Related U.S. Application Data

(63) Continuation of application No. PCT/CN2022/105091, filed on Jul. 12, 2022.

(30) Foreign Application Priority Data

Nov. 22, 2021 (CN) ..... 202111381724.1

(51) Int. Cl.
*E02D 23/16* (2006.01)
*E02D 3/12* (2006.01)

(52) U.S. Cl.
CPC ..... *E02D 23/16* (2013.01); *E02D 3/123* (2013.01)

(58) Field of Classification Search
CPC ..... E02D 3/12; E02D 3/123; E02D 23/08; E02D 23/16
See application file for complete search history.

(56) References Cited

U.S. PATENT DOCUMENTS 1,847,814 A * 3/1932 Byrne, Jr. ..... E02D 23/14 405/248
3,779,322 A * 12/1973 Stevens ..... E21B 10/02 405/133

(Continued)

FOREIGN PATENT DOCUMENTS

CN 107268650 A 10/2017
CN 109695250 A 4/2019

(Continued)

OTHER PUBLICATIONS

Gu, Preliminary study on the law of caisson sinking movement, Port & Waterway Engineering, No. 8, pp. 1-4 and 13, dated Aug. 28, 1988.

(Continued)

*Primary Examiner* — Tara Mayo
(74) *Attorney, Agent, or Firm* — Westbridge IP LLC

(57) ABSTRACT

A method for preventing sudden subsidence of an open caisson in a soft foundation includes the following steps: a position of the open caisson is determined; grouting is carried out to reinforce a foundation of the open caisson; an open caisson manufacturing site is leveled; sections of the open caisson are manufactured and installed; the step of sections of the open caisson are manufactured and installed is repeated until all the sections are manufactured and the open caisson subsides in place as a whole.

9 Claims, 8 Drawing Sheets

(56) References Cited

U.S. PATENT DOCUMENTS

| | | | | |
|---|---|---|---|---|
| 4,990,026 | A * | 2/1991 | Ofenstein | E02D 35/00<br>405/249 |
| 11,746,493 | B2 * | 9/2023 | Wen | E02D 19/18<br>405/195.1 |

FOREIGN PATENT DOCUMENTS

| | | | |
|---|---|---|---|
| CN | 111395374 | A | 7/2020 |
| CN | 111894027 | A | 11/2020 |
| CN | 213390194 | U | 6/2021 |
| CN | 113818466 | A | 12/2021 |
| JP | 2008025225 | A | 2/2008 |

OTHER PUBLICATIONS

International Search Report issued in corresponding PCT Application No. PCT/CN2022/105091, dated Sep. 26, 2022.

* cited by examiner

METHOD FOR PREVENTING SUDDEN SUBSIDENCE OF OPEN CAISSON IN SOFT FOUNDATION

CROSS-REFERENCE TO RELATED APPLICATIONS

This application is a continuation of International Application No. PCT/CN2022/105091, filed on Jul. 12, 2022, which claims priority to Chinese Patent Application No. 202111381724.1, filed on Nov. 22, 2021. All of the aforementioned applications are incorporated herein by reference in their entireties.

TECHNICAL FIELD

The application belongs to the field of building constructions, and provides a method for preventing sudden subsidence of an open caisson in a soft foundation.

BACKGROUND

An open caisson is a shaft-shaped structure without an upper cover and a lower bottom, soil is dug in the open caisson in a construction process, and the open caisson subsides by overcoming a friction resistance between a wall and a soil body by its own gravity. As a foundation of a building or other structures, in the process of subsidence of the open caisson, because soil at the bottom is soft and complex, if the open caisson is directly excavated for subsidence, the phenomenon that the open caisson subsides suddenly or subsides more than once may easily occur, consequently, surrounding buildings are influenced, and potential safety hazards are also brought to constructors.

SUMMARY

The application provides a method for preventing sudden subsidence of an open caisson in a soft foundation, for solving the problems in the relevant art.

The method for preventing sudden subsidence of an open caisson in a soft foundation includes the following steps.

In S1, a position of the open caisson is determined,

In S2, grouting is carried out to reinforce a foundation of the open caisson, and the foundation of the open caisson is located at the bottom of the wall of the open caisson.

In S3, an open caisson manufacturing site is leveled.

In S4, sections of the open caisson are manufactured and installed.

(1) Sections of the open caisson are manufactured, and bearing units are fixedly installed on the inner sides of the upper parts of the sections.

(2) The first section is enabled to subside.

(3) The mass of the second section is calculated, a load with the same weight as the section is placed on the bearing unit of the first section, and the first section is pre-pressed for 24 h with the load.

(4) If the first section has no obvious sudden subsidence, the load is taken out, and the second section is installed by subsidence.

(5) If the first section has sudden subsidence, a construction solution is re-adjusted.

In S5, S4 is repeated until all the sections are manufactured and the open caisson subsides in place as a whole.

Furthermore, in S2, the construction steps of the foundation of the open caisson are as follows.

In S1, the proportion of cement slurry is calculated and allocated.

In S2, grouting holes are formed.

In S3, cement slurry is injected into the grouting holes, and grouting is carried out to form the foundation of the open caisson.

Furthermore, the grouting holes are divided into two rows and are disposed at uniform intervals in a ring shape, the first row of the grouting holes is located on the outer side of the open caisson, and the second row of the grouting holes is located on the inner side of the open caisson; and the two rows of grouting holes are disposed in a staggered mode at intervals.

Furthermore, the second row of the grouting holes are located at the bottom of the wall of the open caisson.

Furthermore, in S4, a plurality of convex blocks is uniformly disposed on the outer wall of the section.

Furthermore, when the next section is installed, the number and size of the convex blocks are adjusted according to the subsidence condition of the previous section.

Furthermore, the convex blocks are disposed in a staggered mode at intervals.

Furthermore, in S3, the bottom end face of the section is a plane.

The bearing unit includes a plurality of brackets and a frame, the brackets are fixedly installed on the inner side of the upper part of the section at uniform intervals, the frame is fixedly installed on the plurality of brackets, and a support is fixedly installed at the bottom of the frame; and a template is laid on the top of the frame.

Furthermore, the frames are connected end to end to form a ring structure.

Furthermore, the frame is made of I steel.

The disclosure has the following advantages and positive effects.

According to the method for preventing sudden subsidence of an open caisson in a soft foundation, while the foundation of the open caisson is disposed for reinforcing soil at the bottom of the open caisson, the bearing of the section is tested through pre-pressing with the load, then the sudden subsidence of the open caisson is further prevented, and by disposing the convex blocks, excessive impact force brought to the bottom section by too fast subsidence of the section may be avoided. The method is suitable for construction on soft soil, loss caused by the phenomenon of sudden subsidence may be avoided, and personal safety of constructors may be guaranteed.

According to the method for preventing sudden subsidence of an open caisson in a soft foundation, by disposing the foundation of the open caisson at the bottom of the open caisson for reinforcing soil at the bottom of the open caisson, construction may still be carried out smoothly in an environment with soft soil, and the phenomenon that the open caisson subsides suddenly in the construction process may be effectively avoided. The proportion of the cement slurry for grouting may be adjusted according to the field condition, so that the stability of an installation process of the open caisson is further improved, and property loss and potential safety hazards caused by the phenomenon of sudden subsidence are avoided.

According to the method for preventing sudden subsidence of an open caisson in a soft foundation, the load when the section is installed is simulated through the pre-pressing load, in match with the foundation of the open caisson at the bottom of the open caisson, load testing is carried out before the next section is installed, so that sudden subsidence of the open caisson in an actual installation process is further prevented, and unnecessary loss is avoided.

According to the method for preventing sudden subsidence of an open caisson in a soft foundation, by disposing the convex blocks on the outer wall of the section, a friction force between the section and soil may be increased to slow down the subsidence speed of the section, so as to reduce the impact force of the upper section on the bottom section and avoid sudden subsidence of the bottom section due to excessive force. The number and size of the convex blocks may be flexibly adjusted according to the installation condition of the previous section, so that sudden subsidence of the section may be prevented, subsidence difficulty may also be avoided, and construction may be carried out smoothly.

According to the method for preventing sudden subsidence of an open caisson in a soft foundation, the bottom end face of the section is made into a plane, then the cross-sectional area between the bottom surface of the section and soil on the horizontal plane is increased, so as to reduce the intensity of pressure of the soil, prevent the sudden subsidence of the open caisson and reduce the construction risk.

According to the method for preventing sudden subsidence of an open caisson in a soft foundation, through the foundation of the open caisson in match with pre-pressing testing of the section, the phenomenon of sudden subsidence is effectively prevented, the operation is simple, convenient and practical, various parameters in construction are adjusted in real time, the construction mode is flexible, which may adapt to different construction environments, the influence of sudden subsidence of the open caisson on surrounding buildings is effectively avoided, and potential safety hazards are eliminated.

DETAILED DESCRIPTION OF THE EMBODIMENTS

Figure 1:
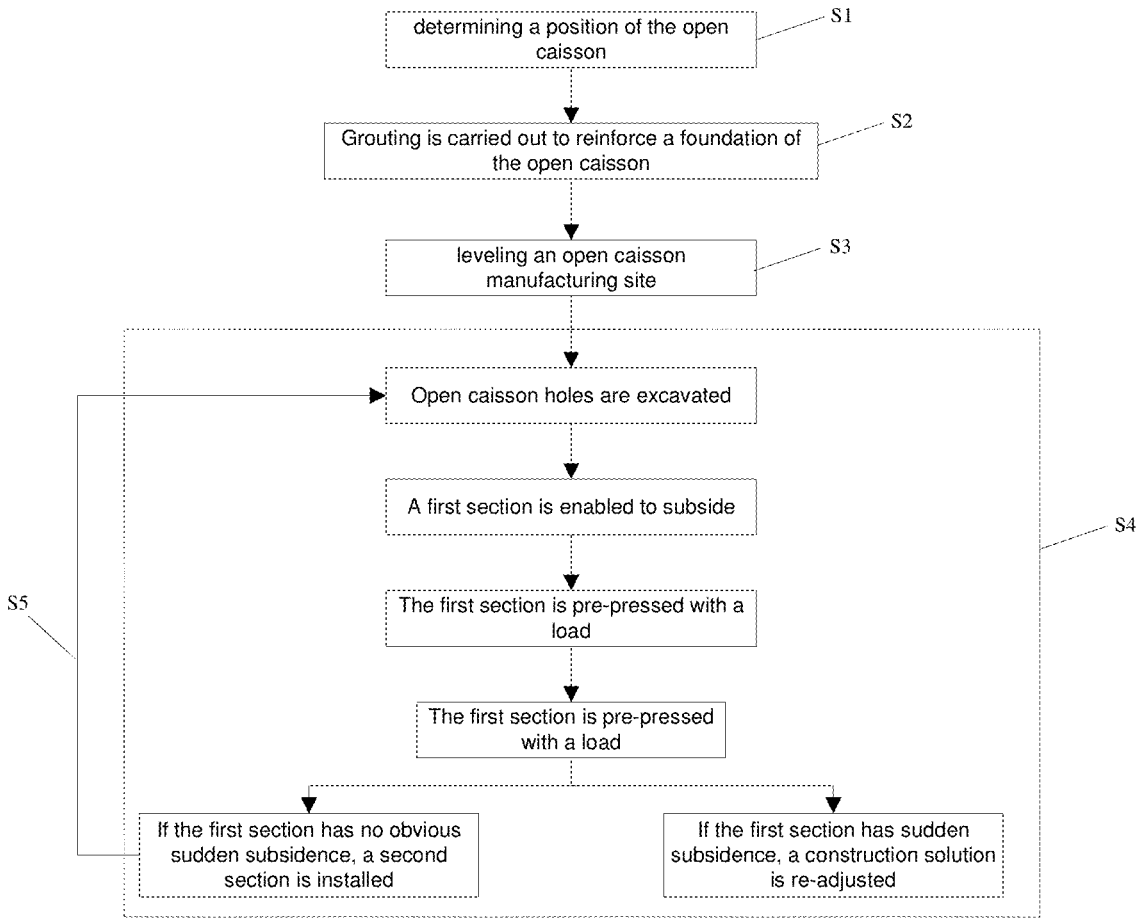
FIG. 1 is a flowchart of steps of the application.

The application will be further described with reference to drawings.

The method for preventing sudden subsidence of an open caisson in a soft foundation provided by the application includes the following steps.

In S1, a position of the open caisson is determined.

In S2, grouting is carried out to reinforce a foundation 9 of the open caisson, and the foundation 9 of the open caisson is located at the bottom of the wall of the open caisson.

In S3, an open caisson manufacturing site is leveled, and open caisson holes are excavated.

In S4, sections 3 of the open caisson are manufactured and installed, comprising the following steps:

(1) Sections 3 of the open caisson are manufactured, and bearing units are fixedly installed on the inner sides of the upper parts of the sections 3.

(2) The first section 3 is enabled to subside.

(3) The mass of the second section 3 is calculated, a load 4 with the same weight as the section 3 is placed on the bearing unit of the first section 3, and the first section 3 is pre-pressed for 24 h with the load 4.

(4) If the first section 3 has no obvious sudden subsidence, the load 4 is taken out, and the second section 3 is installed by subsidence.

(5) If the first section 3 has sudden subsidence, a construction solution is re-adjusted.

In S5, S4 is repeated until all the sections 3 are manufactured and the open caisson subsides in place as a whole.

Furthermore, in S2, the construction steps of the foundation 9 of the open caisson are as follows.

In S1, the proportion of cement slurry is calculated and allocated.

In S2, grouting holes 7 are formed.

In S3, cement slurry is injected into the grouting holes 7, and grouting is carried out to form the foundation 9 of the open caisson.

Figure 3:
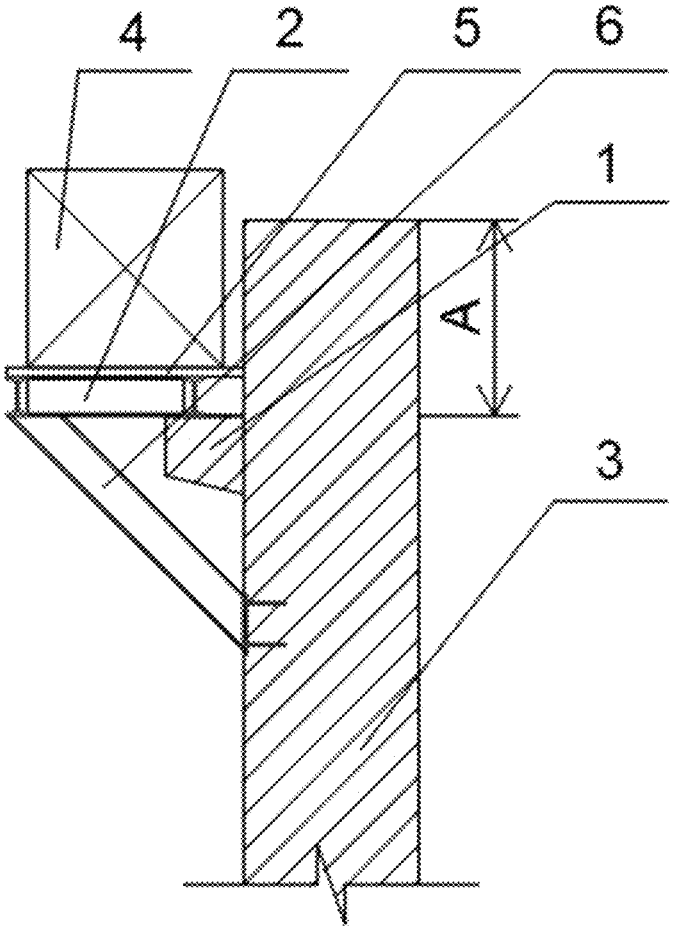
FIG. 3 is a schematic diagram of a longitudinal section view of a bearing unit of the application.
Figure 4:
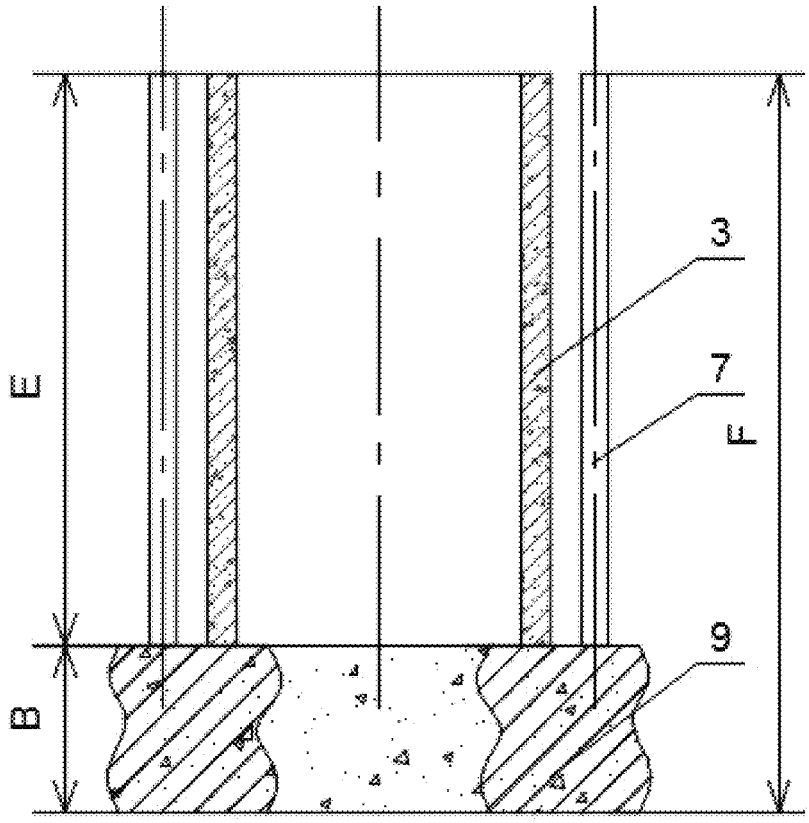
FIG. 4 is a schematic diagram of a longitudinal section view of an open caisson and a foundation of the open caisson of the application.

Furthermore, in S2, the grouting holes 7 are divided into two rows and are disposed at uniform intervals in a ring shape, as shown in FIGS. 3 and 4, the first row of the grouting holes 7 is located on the outer side of the open caisson, the second row of the grouting holes 7 is located on the inner side of the open caisson, preferably, the second row of the grouting holes 7 is uniformly arranged at the bottom of the wall of the open caisson, the axial spacing of each grouting hole 7 is 1 m, the central axis of the two rows of grouting holes 7 and the central axis of the open caisson coincide, the first row of grouting holes 7 and the second row of grouting holes 7 are separated by 1 m, and the two rows of grouting holes 7 are disposed in a staggered mode at intervals.

Furthermore, in the grouting process of S3, the grouting height B in the two rows of grouting holes 7 is 4 m, and the height F of the grouting hole 7 is equal to the height E of the open caisson plus the height B of the foundation 9 of the open caisson. The cement slurry diffuses around the grouting holes 7, and finally forms the foundation 9 of the open caisson, and the foundation 9 of the open caisson is a foundation of a ring-shaped structure.

Figure 2:
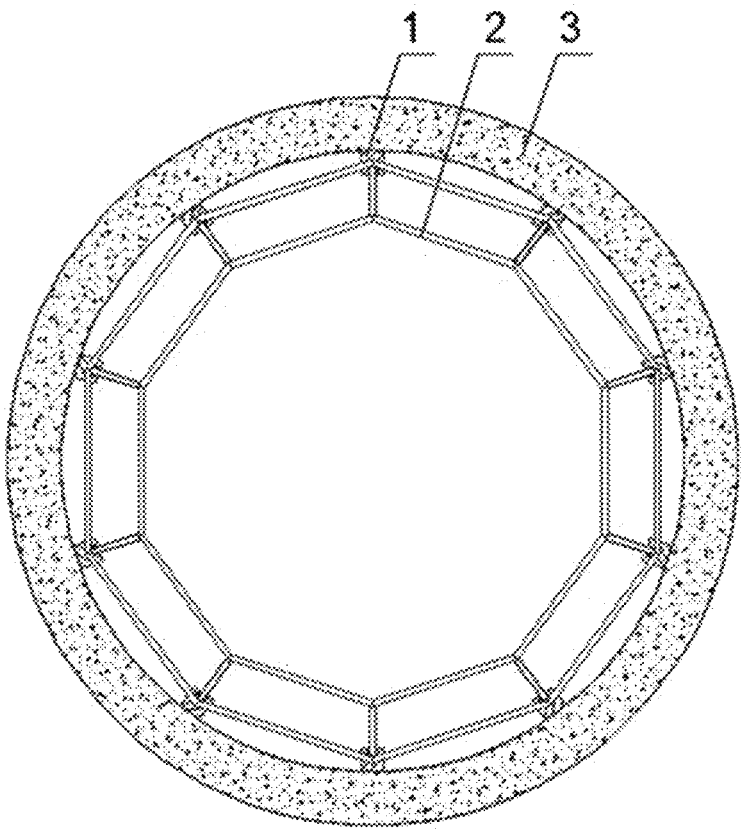
FIG. 2 is a schematic diagram of a top view of an open caisson and a bearing unit of the application.

Furthermore, in S4, the bearing unit includes a plurality of brackets 1 and a frame 2, as shown in FIGS. 1 and 2, the brackets 1 are fixedly installed on the inner side of the upper part of the section 3 at uniform intervals, and the distance A between the top surface of the bracket 1 and the top surface of the section 3 is 1000 mm. The frame 2 made of I steel is fixedly installed on the plurality of brackets 1, the frame 2 and the bracket 1 are welded through embedded steel plates, the size of the embedded steel plate is 300 mm*300 mm*10 mm. A support 6 is fixedly installed at the bottom of the frame 2; and a template 5 is laid on the top of the frame 2 (the template 5 is not shown in the FIG. 1). Furthermore, the frames 2 are connected end to end to form a ring structure. The length of the bracket 1 is 400 mm, the width is 400 mm, the height is 300 mm-400 mm, the linear spacing of the brackets 1 is 3000 mm, and the type of the I steel is 20 #A (200*100*7 mm).

Figure 5:
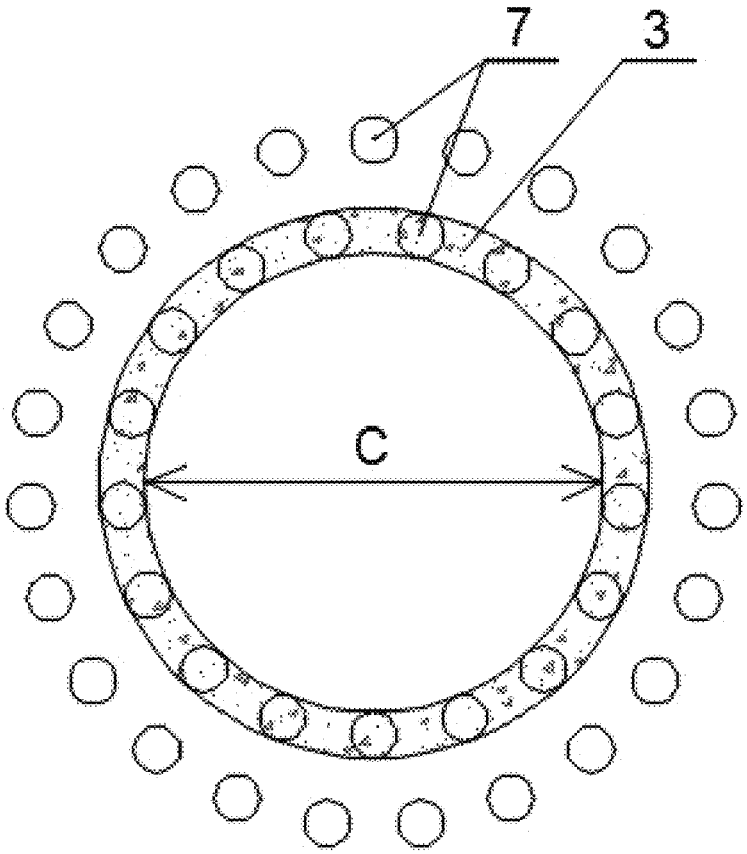
FIG. 5 is a schematic diagram of a top view of an open caisson and a grouting hole of the application.
Figure 6:
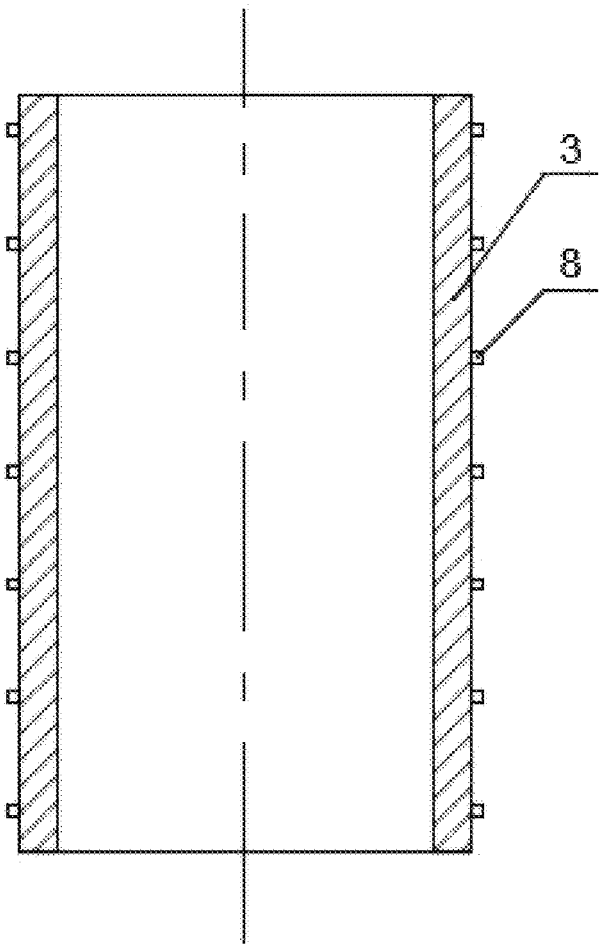
FIG. 6 is a schematic diagram of a longitudinal section view of an open caisson provided with convex blocks of the application.
Figure 7:
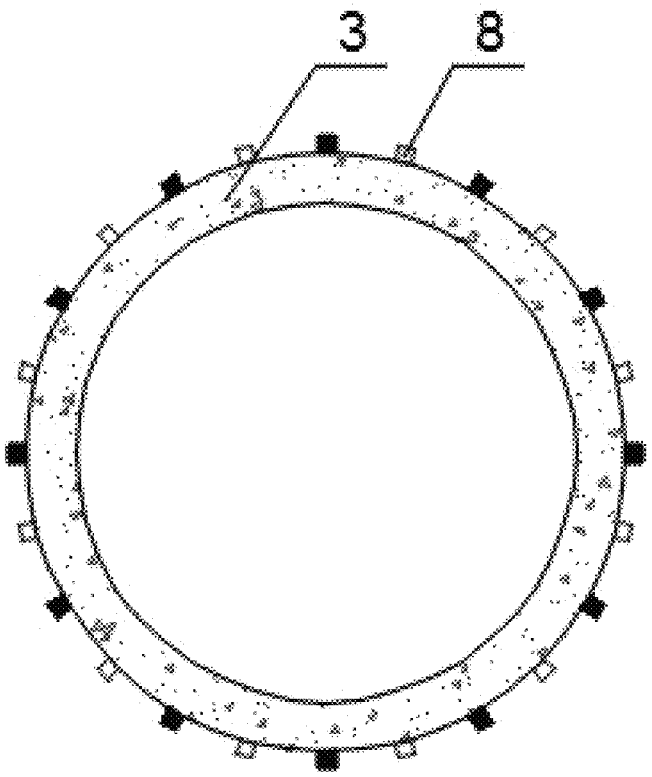
FIG. 7 is a schematic diagram of a top view of an open caisson provided with convex blocks of the application.
Figure 8:
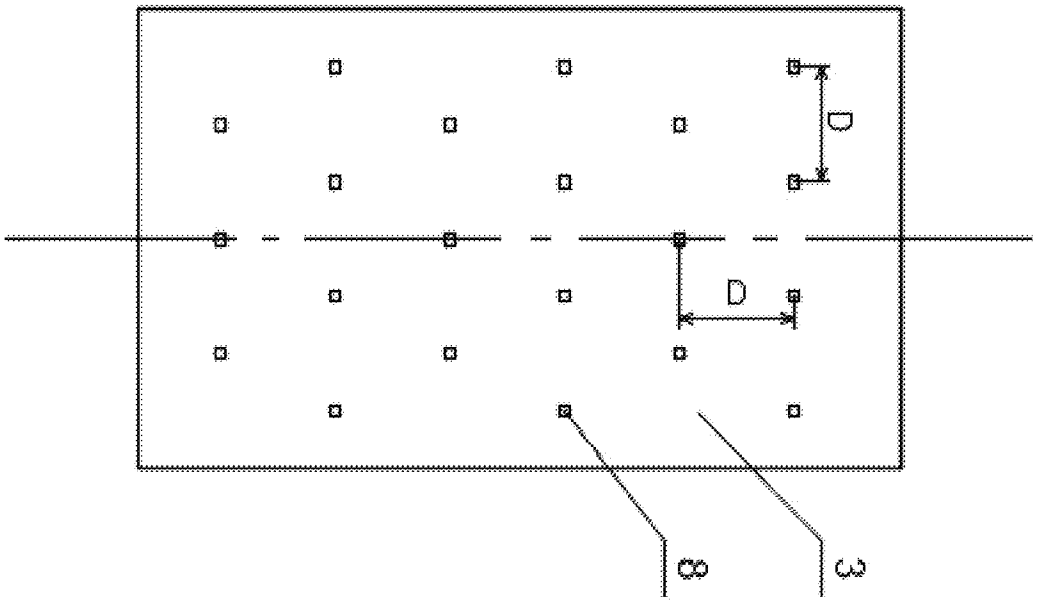
FIG. 8 is a schematic diagram of a front view of an open caisson provided with convex blocks of the application.

Furthermore, in S4, a plurality of convex blocks 8 are uniformly disposed on the outer wall of the open caisson for increasing friction force between the open caisson and soil, as shown in FIGS. 5, 6 and 7, the upper and lower adjacent rows of convex blocks 8 are disposed in a staggered mode at intervals. The convex block 8 is a cube of 150 mm*150 mm*150 mm, and the horizontal spacing D and vertical spacing D of the convex block 8 are 1500 mm.

Furthermore, in S4, the area of the cutting edge at the bottom of the open caisson is increased, or the bottom end face of the open caisson is made into a plane, so as to slow down the subsidence speed of the open caisson.

Furthermore, in S4, sandbags are uniformly stacked on the bearing unit of the first section 3 along the inner wall of the open caisson until the total load of the sandbags is equal to that of the second section 3. After the first section 3 is pre-pressed for 24 h with the load 4, the sandbags may be taken out to install the second section 3 if the section 3 has no obvious sudden subsidence, so as to prevent sudden subsidence of the second section 3 during the installation. If the first section 3 has sudden subsidence during the pre-pressing process, a construction solution is re-adjusted.

Furthermore, in S4, after the previous section 3 is installed, the proportion of cement slurry for grouting of the next section 3 and the number and size of the convex blocks 8 are re-adjusted according to the subsidence condition of the previous section 3.

Furthermore, the inner diameter of the section 3 is 5000 mm.

According to the method for preventing sudden subsidence of an open caisson in a soft foundation, while the foundation of the open caisson is disposed for reinforcing soil at the bottom of the open caisson, the bearing of the section is tested through pre-pressing with the load, then sudden subsidence of the open caisson is further prevented, and by disposing the convex blocks, excessive impact force brought to the bottom section by too fast subsidence of the section may be avoided. The method is suitable for construction on soft soil, loss caused by the phenomenon of sudden subsidence may be avoided, and personal safety of constructors may be guaranteed.

According to the method for preventing sudden subsidence of an open caisson in a soft foundation, by disposing the foundation of the open caisson at the bottom of the open caisson for reinforcing soil at the bottom of the open caisson, construction may still be carried out smoothly in an environment with soft soil, and the phenomenon that the open caisson subsides suddenly in the construction process may be effectively avoided. The proportion of the cement slurry for grouting may be adjusted according to the field condition, so that the stability of an installation process of the open caisson is further improved, and property loss and potential safety hazards caused by the phenomenon of sudden subsidence are avoided.

According to the method for preventing sudden subsidence of an open caisson in a soft foundation, the load when the section is installed is simulated through the pre-pressing load, in match with the foundation of the open caisson at the bottom of the open caisson, load testing is carried out before the next section is installed, so that sudden subsidence of the open caisson in an actual installation process is further prevented, and unnecessary loss is avoided.

According to the method for preventing sudden subsidence of an open caisson in a soft foundation, by disposing the convex blocks on the outer wall of the section, a friction force between the section and soil may be increased to slow down the subsidence speed of the section, so as to reduce the impact force of the upper section on the bottom section and avoid sudden subsidence of the bottom section due to excessive force. The number and size of the convex blocks may be flexibly adjusted according to the installation condition of the previous section, so that sudden subsidence of the section may be prevented, subsidence difficulty may also be avoided, and construction may be carried out smoothly.

According to the method for preventing sudden subsidence of an open caisson in a soft foundation, the bottom end face of the section is made into a plane, then the cross-sectional area between the bottom surface of the section and soil on the horizontal plane is increased, so as to reduce the intensity of pressure of the soil, prevent the sudden subsidence of the open caisson and reduce the construction risk.

According to the method for preventing sudden subsidence of an open caisson in a soft foundation, through the foundation of the open caisson in match with pre-pressing testing of the section, the phenomenon of sudden subsidence is effectively prevented, the operation is simple, convenient and practical, various parameters in construction are adjusted in real time, the construction mode is flexible, which may adapt to different construction environments, the influence of sudden subsidence of the open caisson on surrounding buildings is effectively avoided, and potential safety hazards are eliminated.

It is apparent that the above-described embodiments are merely examples made for clarity of illustration and are not limiting of the implementation modes. For those of ordinary skill in the art, other variations or modifications in different forms may be made in light of the above description It is not necessary and impossible to provide all the implementation modes here. Obvious changes or variations therefrom are still within the scope of protection of the disclosure.

What is claimed is:

1. A method for preventing sudden subsidence of an open caisson in a soft foundation, comprising the following steps:

S1, determining a position of the open caisson;

S2, carrying out grouting to reinforce a foundation of the open caisson, and the foundation of the open caisson being located at a bottom of a wall of the open caisson;

S3, levelling an open caisson manufacturing site;

S4, manufacturing and installing sections of the open caisson, comprising:

I, manufacturing sections of the open caisson, and fixedly installing bearing units on the inner sides of the upper parts of the sections; the bearing unit comprises a plurality of brackets and a frame, the brackets are fixedly installed on the inner side of the upper part of the section at uniform intervals, the frame is fixedly installed on the plurality of brackets, and a support is fixedly installed at the bottom of the frame; and a template is laid on the top of the frame;

II, enabling the first section to subside;

III, calculating the mass of the second section, placing a load with the same weight as the section on the bearing unit of the first section, and pre-pressing the first section for 24 h with the load;

IV, if the first section has no obvious subsidence, taking out the load, and installing the second section by subsidence; and V, if the first section has subsidence, re-adjusting a construction solution;

S5, repeating S4 until all the sections are manufactured and the open caisson subsides in place as a whole.

2. The method for preventing sudden subsidence of the open caisson in the soft foundation according to claim 1, wherein in S2, the construction steps of the foundation of the open caisson comprise:

step 1, calculating and allocating the proportion of cement slurry;

step 2, forming grouting holes; and step 3, injecting cement slurry into the grouting holes, and carrying out grouting to form the foundation of the open caisson.

3. The method for preventing sudden subsidence of the open caisson in the soft foundation according to claim 2, wherein the grouting holes are divided into two rows and are disposed at uniform intervals in a ring shape, the first row of the grouting holes is located on the outer side of the open caisson, and the second row of the grouting holes is located on the inner side of the open caisson; and the two rows of grouting holes are disposed in a staggered mode at intervals.

4. The method for preventing sudden subsidence of the open caisson in the soft foundation according to claim 3, wherein the second row of the grouting holes is located at the bottom of the wall of the open caisson.

5. The method for preventing sudden subsidence of the open caisson in the soft foundation according to claim 1, wherein in S4, a plurality of convex blocks are uniformly disposed on the outer wall of the section.

6. The method for preventing sudden subsidence of the open caisson in the soft foundation according to claim 5, wherein when the next section is installed, the number and size of the convex blocks are adjusted according to the subsidence condition of the previous section.

7. The method for preventing sudden subsidence of the open caisson in the soft foundation according to claim 5, wherein the convex blocks are disposed in a staggered mode at intervals.

8. The method for preventing sudden subsidence of the open caisson in the soft foundation according to claim 1, wherein in S4, a bottom end face of the section is a plane.

9. The method for preventing sudden subsidence of the open caisson in the soft foundation according to claim 1, wherein the frames are connected end to end to form a ring structure.

* * * * *